US007074075B2

(12) United States Patent
Miyazawa

(10) Patent No.: US 7,074,075 B2
(45) Date of Patent: Jul. 11, 2006

(54) REDUCED-SIZE CONNECTOR

(75) Inventor: Junichi Miyazawa, Yokohama (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/981,314

(22) Filed: Nov. 4, 2004

(65) Prior Publication Data

US 2005/0106932 A1 May 19, 2005

(30) Foreign Application Priority Data

Nov. 4, 2003 (JP) ..... 2003-374397
Apr. 2, 2004 (JP) ..... 2004-109764

(51) Int. Cl.
*H01R 12/24* (2006.01)

(52) U.S. Cl. ..... 439/499; 439/465; 439/874

(58) Field of Classification Search ..... 439/499, 439/492, 465, 752, 874
See application file for complete search history.

(56) References Cited

U.S. PATENT DOCUMENTS 3,737,833 A * 6/1973 Jerominek ..... 439/61
3,941,448 A * 3/1976 Evans ..... 439/493
3,950,068 A 4/1976 Schmieg
4,033,658 A 7/1977 Asick
4,682,840 A 7/1987 Lockard
4,880,401 A 11/1989 Shima et al.
4,993,968 A * 2/1991 Guletsky et al. ..... 439/492
5,064,391 A 11/1991 Buchter
5,415,567 A 5/1995 Fusselman et al.
6,066,000 A * 5/2000 Masumoto et al. ..... 439/607
6,139,363 A * 10/2000 Ko et al. ..... 439/579
6,217,396 B1 4/2001 Hwang et al.
6,325,681 B1 12/2001 Doi
6,475,024 B1 * 11/2002 Narui ..... 439/495
6,793,527 B1 * 9/2004 Noro ..... 439/579

FOREIGN PATENT DOCUMENTS

JP 3004463 1/1991
JP 3210776 9/1991

* cited by examiner

*Primary Examiner*—Briggitte Hammond
*Assistant Examiner*—X. Chung-Trans
(74) *Attorney, Agent, or Firm*—Thomas D. Paulius

(57) ABSTRACT

An electrical connector is provided for terminating a plurality of electrical cables arranged in parallel and having exposed core conductors at distal ends of the cables. The connector includes a housing which mounts a plurality of elongated, flat plate-like terminals in a generally parallel array. Each terminal includes a rear mounting end for mounting the terminal on the housing and a plate-like contact/termination end projecting forwardly of the mounting end. One flat surface of the plate-like contact/termination end is soldered to the core conductor of a respective one of the electrical cables. An opposite flat surface of the plate-like contact/termination end is exposed for engaging an appropriate contact of a complementary mating connector.

27 Claims, 8 Drawing Sheets

REDUCED-SIZE CONNECTOR

BACKGROUND OF INVENTION

This invention generally relates to small-sized electrical connectors and, more particularly, to an electrical connector for connecting a plurality of wires to a mating connector that is mounted to a circuit board.

The market for mobile telephones for consumers is constantly expanding. Mobile telephones, which are commonly referred to as "cell phones" now have the capability to send and receive e-mails, connect to the Internet and take and transmit digital photographs.

Consumers want their cell phones to be small so that they may be easily carried in a pocket or on a belt, but they also want their phones to have all these electronic features. In order to pack these features into a small form factor for a cell phone, the feature components and their associated circuitry, including connectors must be small. It is therefore desired to develop connectors of the smallest possible size which provide reliable connections. Also, many of the cell phones is use in today's market have a speaker portion which not only is hinged to the main body of the telephone, but also is capable of rotating with respect to the main body. Such a construction not only applies linear forces to the wires that interconnect the speaker portion to the telephone body portion, but also rotational or torsional forces to the wires.

Electrical cable connectors typically have an insulative housing having a mating end for mating with a mating connector and a terminating end from which a plurality of wires extend. The housing mounts a plurality of conductive terminals which have contact portions at the mating end of the housing for engaging appropriate contacts of the mating connector, and terminating portions for connection, as by soldering, to the conductors of the wires. The terminals typically also include fixing portions for fixing the terminals in the housing. Most often, the contact portion, the terminating portion and the fixing portion of a terminal are arranged in substantially a straight line. This arrangement causes problems because it increases the overall length of the connector and the electronic device in which the connector is used.

FIGS. 18–20 show a wire connector of the prior art as is shown in Japanese Publications JP 3343578 B and JP 2001-28282 A. This connector incorporates terminals which are designed to achieve miniaturization at least in the length of the connector from the mating end to the rear end thereof.

Specifically, FIGS. 18–20 show an electrical cable connector 21, which includes a housing 22. The housing mounts a plurality of terminals, 23, which are arranged in parallel along the housing. A wire 24 is terminated to each terminal, and the terminal engages a contact pin 25 of a complementary mating connector (not shown).

Each terminal 23 of prior art connector 21 includes a fixing portion 23*a* and a terminating portion 23*b* in a generally straight line. However, an L-shaped contact portion 23*c* is shown as offset from and generally parallel to the terminating portion. This reduces the overall length of the terminal to some extent. Fixing portion 23*b* has a contact point 23*d* (FIG. 20) and the contact portion 23*c* has an opposing contact point 23*e*. The contact points cooperatively form a mouth into which a contact pin 25 of the mating connector is inserted. Each terminal is mounted within a respective terminal-receiving passage 22*a* within the housing, and the housing has a hole 22*b* in alignment with the mouth and through which contact pin 25 of the mating connector is inserted. For completion purposes only, the connector also includes a metal shell, generally designated 26, which has a top wall 26*a* and a bottom wall 26*b* for shielding the connector. Electrical cable 24 includes a center core conductor 24*a* surrounded by a dielectric 24*b*. The core is soldered to terminating portion 23*b* of terminal 23. The metal shield has a rear, inwardly bent flange 26*c* which encloses a positioning plate 27 and a cable clamping plate 28. Finally, housing 22 includes a plurality of rear holes 22*c* for receiving the cables which extends into an interior opening 22*d* that communicates with a plurality of interior passages 22*e* (FIG. 19) for receiving core conductors 24*a* which are soldered to terminating portions 23*b* of the terminals before metal shell 26 is installed.

While the configuration of terminals 23 of prior art connector 21 is arranged to reduce the length of the connector between the mating end and the terminating end thereof, these terminals create further problems because their structure increases the thickness and/or width of the connector because the contact portions 23*c* of the terminals are offset from, or spaced to the side, or width, direction of terminating portions 23*b* of the terminals. The present invention is directed to a small-size connector that overcomes these disadvantages.

SUMMARY OF THE INVENTION

Accordingly, it is a general object of the present invention to provide a new and improved connector for terminating a plurality of electrical wires with exposed conductors at distal ends of the cables, wherein the connector has a reduced size.

Another object of the present invention is to provide a connector for connecting a plurality of wires to a connector mounted on a circuit board in which the connector has reduced width and thickness dimensions.

A further object of the present invention is to provide a connector for wire-to-board applications, the connector having a plurality of conductive terminals, the terminals being formed from a conductive metal and bent upon themselves to define formed ends of the terminals, the terminals having elongated portions that have a contact face on one surface thereof and a terminating face on the other surface thereof, the terminals being plated with a non-solder adhering plating on the contact faces thereof and a solder-adhering plating on the terminating faces thereof so that solder used to connect the wire conductors to the terminal terminating faces will not flow from the terminating faces to the contact faces.

A still further object of the present invention is to provide a terminal having a forward end that is bent upon itself to define a first nest area proximate to the terminal front end that may accommodate an exposed conductor of a cable for termination to the terminal and the terminal is bent a second time to form an offset bend therein and as second nest proximate to the rear end of the terminal.

Yet a further object of the present invention is to provide a connector of reduced size having a plurality of conductive terminals arranged in side-by-side order, each of the terminals having a contact portion, a tail portion and a body portion interconnecting the contact and tail portions together, the tail portions including a recess, or notch, formed therein, the recesses receiving an engagement lug of a connector housing.

The present invention accomplishes these and other objects by way of its structure.

In one embodiment of the invention, the connector includes an insulative housing which mounts a plurality of elongated terminals in a generally parallel array. Each terminal includes a rear mounting end for mounting the terminal on the housing and a flat plate-like contact end that projects forwardly of the mounting end. One flat surface of the plate-like contact/termination end is soldered to the conductor of one of the wires. An opposite flat surface of the plate-like contact end is exposed for engaging an appropriate contact of a complementary mating connector.

According to one aspect of the invention, the forward end of each terminal is bent back over the flat surface to define the contact end of the terminal. The forward end is bent back a distance short of a point where the wire conductor is soldered to the opposite side flat surface. The bent back forward end preferably includes a pair of wings projecting laterally outwardly from opposite side edges of the forward end for insertion into opposing grooves in the housing.

According to another aspect of the invention, the connector housing includes a mating plug portion for insertion into a receptacle of the mating connector. The plate-like contact/termination end of each terminal is juxtaposed on the plug portion. The core conductor of the respective electrical cable is sandwiched between the plug portion and the juxtaposed plate-like contact/termination end of the respective terminal. As disclosed herein, the rear mounting end of each terminal includes wings projecting laterally outwardly from opposite side edges thereof for insertion into opposing grooves in the dielectric housing.

According to a further aspect of the invention, a retainer member is provided for use with the connector housing and it is inserted through an opening of the connector housing in order to engage and retain the terminals in the housing.

The retainer member has a plurality of spaced apart lugs that extend down from the retainer member body and each such lug is received within a corresponding recess, or notch, that is formed in each terminal. The terminal recess is aligned with the wire that is attached to the terminal and thus, the retainer member forms a dual function of holding both the terminal and the cable in place within the connector housing. The retainer member extends along the width of the connector housing and fits into an opening formed in the connector housing. The retainer member engages all of the terminals and wires in their side-by-side arrangement.

In a still further aspect of the present invention, the terminals of the connector are formed from a material that is not conducive to soldering, such as phosphor-bronze and the contact surface of the terminals are plated with a conductive plating such as gold, while the termination face of the terminals are plated with a solder-adhering plating, such as tin, so that the wires may be easily and reliably soldered to the terminals without great concern for solder bridging from the termination face to the contact face.

Other objects, features and advantages of the invention will be apparent from the following detailed description taken in connection with the accompanying drawings.

BRIEF DESCRIPTION OF THE DRAWINGS

The invention may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
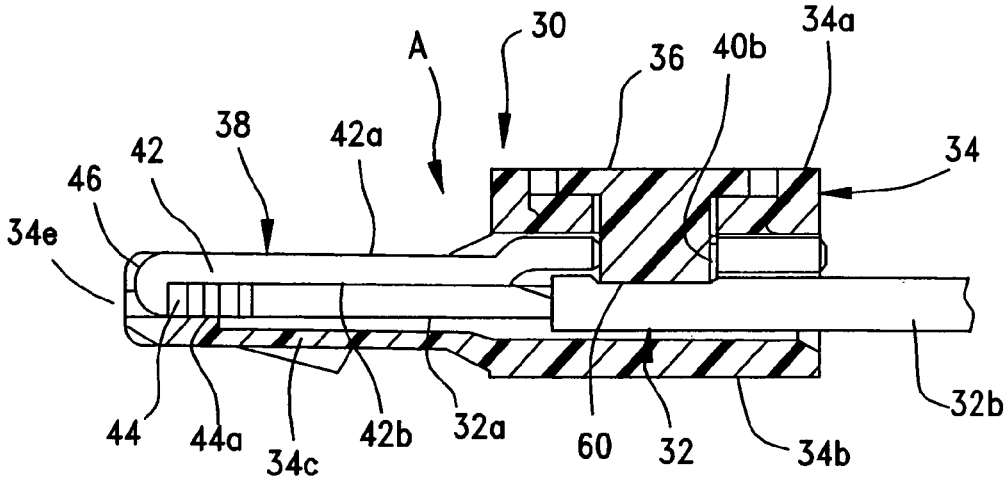
FIG. 1 is a vertical, front-to-rear section through a cable connector constructed in accordance with the principles of the present invention, which houses terminals that are terminated to a plurality of wires in a parallel fashion.
Figure 2:
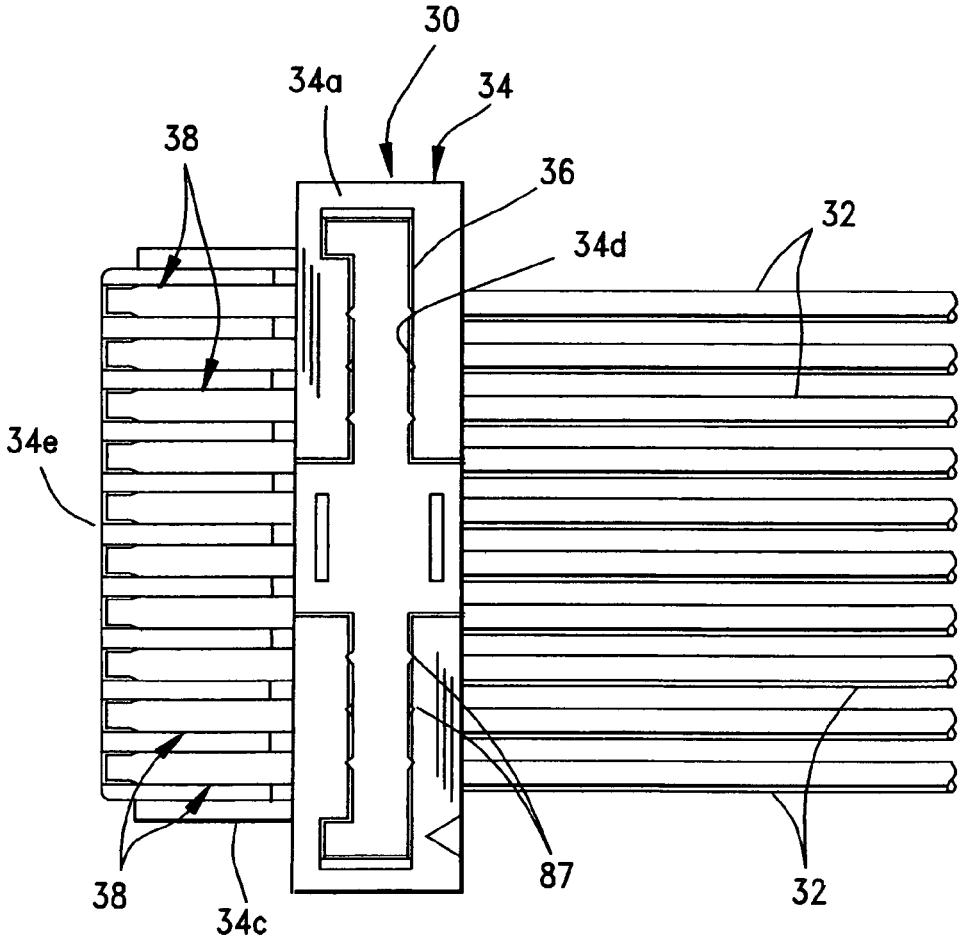
FIG. 2 is a top plan view of the connector as viewed in the direction of arrow "A" in FIG. 1.

Referring to FIGS. 1 and 2, the invention is embodied in an electrical connector, 30, for terminating a plurality of electrical wires 32 arranged in parallel and having exposed conductors 32*a* at distal ends of the wires. The connector includes an insulative housing, generally designated 34, which includes a top wall 34*a*, a bottom wall 34*b* and a forwardly projecting mating plug or blade portion 34*c* with a mating end 34*e*. The housing is elongated widthwise as seen in FIG. 2 in order to receive and support all of the parallel wires, and an elongated slot, or opening, 34*d* is provided in top wall 34*a* for receiving a retainer member 36.

Figure 3:
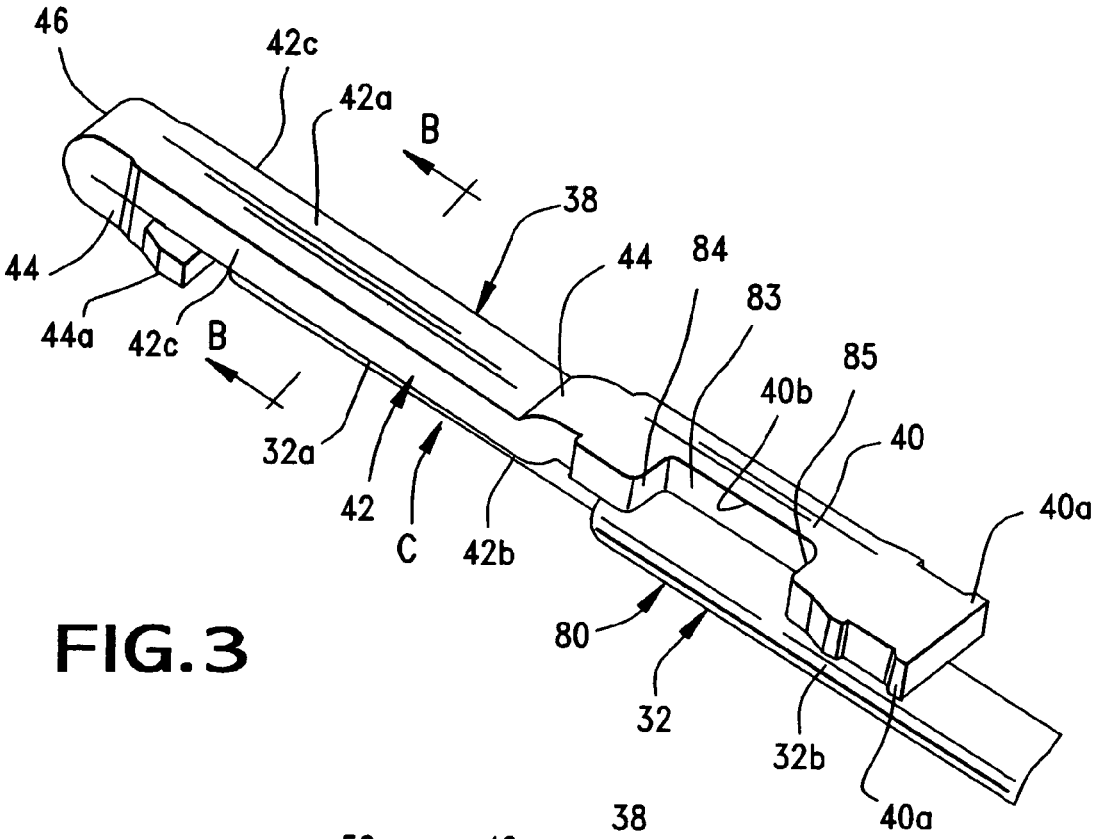
FIG. 3 is a perspective view of one of the terminals of the connector, terminated to a respective wire.
Figure 4:
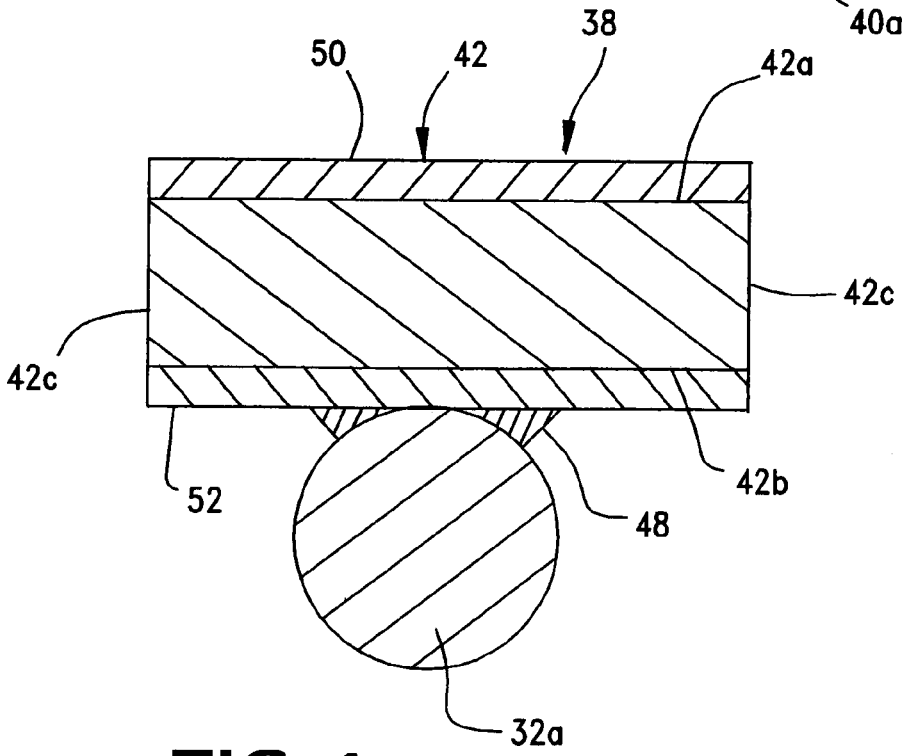
FIG. 4 is an enlarged vertical sectional view taken generally along line B—B in FIG. 3.
Figure 5:
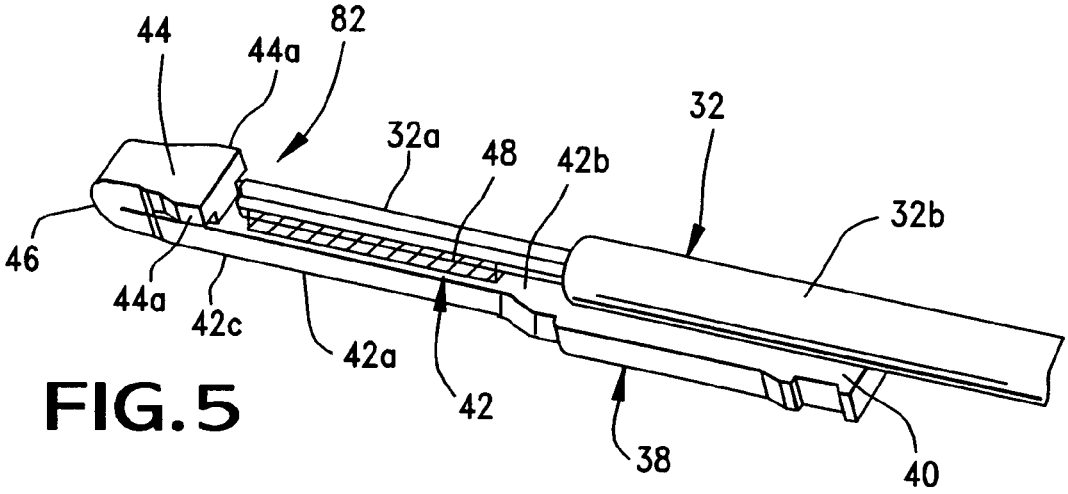
FIG. 5 is a perspective view of the terminal and a wire terminated thereto looking in the direction of arrow "C" in FIG. 3.

Referring to FIGS. 3–5 in conjunction with FIGS. 1 and 2, a plurality of elongated, flat plate-like, conductive terminals, 38, are provided and are mounted in housing 34. Each terminal includes a rear mounting end 40 for mounting the terminal in the housing and a flat plate-like contact end 42 projecting forwardly of the mounting end 40. The terminal is elongated lengthwise, and the contact end 42 is slightly offset from mounting end 40 transversely of the longitudinal end by means of a slight bend 44. This bend 44 creates a first nest 80 of the terminal, which as illustrated in FIG. 3, accommodates the wire 32, and preferably, the portion of the wire 32 having outer insulation 32*b* thereon. As is explained to follow, the projecting lugs 60 of the retainer member 36 project into this nest 80 (FIG. 10) post the bottom surfaces thereof and make contact with the wire outer insulation 32*b* thereon. The lugs 60 also engage the terminals as shown. The rear mounting end 40 of each of the terminals also may include a pair of wings 40*a* projecting outwardly from opposite side edges thereof, along with a recess 40*b*, formed in one side edge thereof.

The contact end 42 has a flat top surface 42*a*, a flat bottom surface 42*b* and opposite side surfaces 42*c* to define a generally rectangular, flat configuration in cross-section (FIG. 4). The forward tip 44 of the contact end is bent, as at 46, upon itself and over the bottom surface 42*b* of the contact end 42 a distance short of a point where the wire conductor 32*a* ends. A pair of wings 44*a* project laterally outwardly from opposite side edges of the bent back forward end 44. These wings 44*a* preferably engage the sides of the grooves 58 that are formed in the connector housing and which receive the terminals. The bent portion 46 of the terminal is located at the contact end (at a free end or tip portion of the terminal) so that it defines at least a portion of the mating end 34*e* of the housing 34. With this arrangement, a conductive edge of the terminal is presented to the mating terminal rather than an edge of a non-conductive housing. Importantly, and as illustrated in FIGS. 3 and 5, the bent front end portion of the terminal defines another, second nest 82 in which the exposed conductor 32*a* of the wire 32 lies and is fixed to the terminal, such as by soldering.

The flat top surface 42*a* of contact end 42 of terminal 38 and the bent portion 46 which is exposed at the mating end 34*e* of the connector housing are best shown in FIG. 3. This flat top surface is exposed on the top of plug portion 34*c* of the housing and the bent portion 46 is exposed at the mating end 34*e* of the housing as best seen in FIG. 1, for engaging an appropriate contact of a complementary mating connector, as is described later. FIG. 5 shows that the wire conductor 32*a* of one of the wires 32 is terminated to the terminal flat bottom surface 42*b*, as by soldering. Therefore, it can be seen that the same longitudinal section of each terminal 38 provides both the contact portion and the terminating portion of the terminal to significantly reduce the overall length of the terminal as well as the connector. Additionally, the contact and termination faces are disposed on opposite surfaces of the flat section of the terminal, so that the thickness (or height) of the terminal is not increased and may be kept to a minimum, as well as the overall height of the connector. The use of the two nests 80 and 82 in the terminals assists in reducing the overall height thickness of the connector because the second nest 82 receives the exposed conductor of each wire, and the first nest 80 receives the outer insulation.

FIG. 4 shows that flat top surface 42*a* of contact end 42 of terminal 38 has a gold-plated layer 50 thereon to increase its conductivity. The terminals may be formed from a solder-resistant material such as nickel, copper-nickel or phosphor-bronze or alloys thereof and then selectively plated. Phosphor bronze is a solder-adherent resistant material and thus the flat bottom surface 42*b* of the terminal is preferably plated with a solder-adherent material such as a tin plating layer 52 thereon. Therefore, the gold and tin layers are completely separated from each other by the terminal base material and only the opposite top and bottom surfaces of the terminal are plated. The base material will therefore act as a solder bridge to reduce the likelihood that solder from the wire-terminal joint will migrate to and contaminate the gold-plated contact surface. FIG. 4 illustrates the preferable location of the solder fillets 48 and how they provide an electrical connection between the wire conductors 32*a* to the terminal flat bottom surface 42*b* by way of contact with the tin-plated layer 52.

Figure 6:
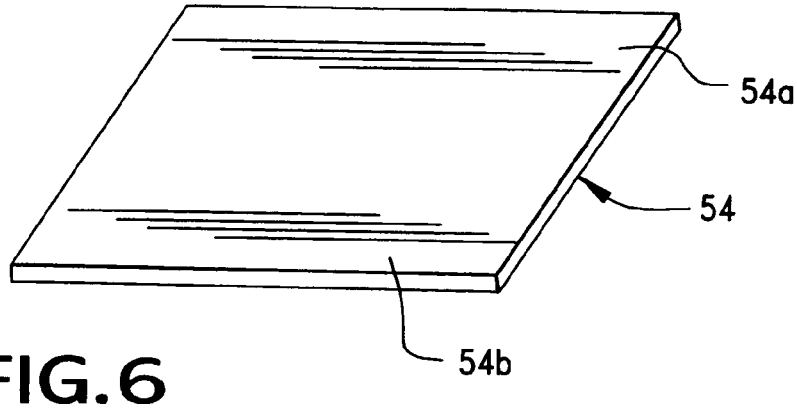
FIG. 6 is a perspective view of a section of conductive sheet metal material from which a plurality of the terminals are stamped and formed, the sheet being on a reduced scale.
Figure 7:
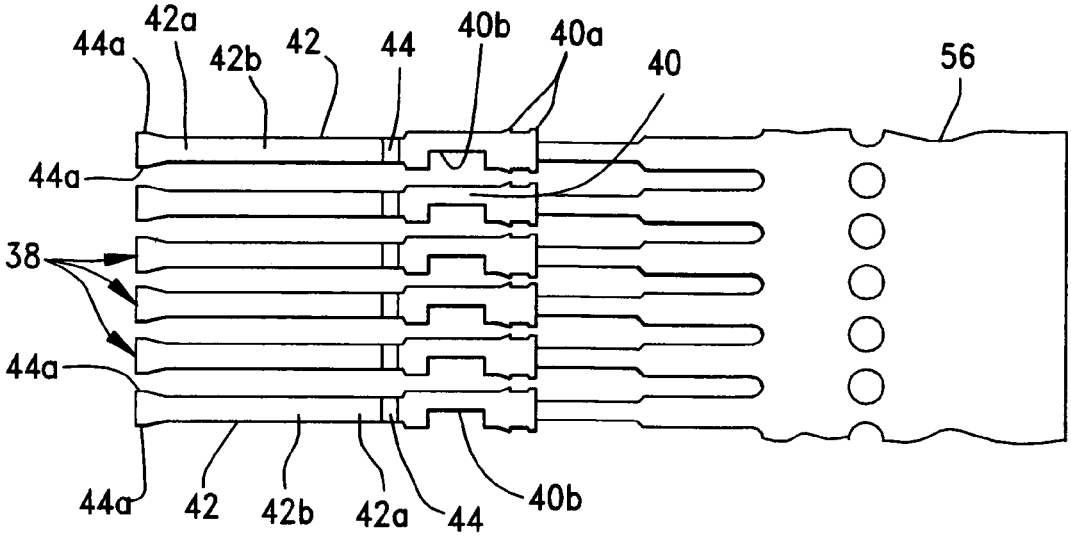
FIG. 7 is a plan view showing a blank having a cluster of terminals as stamped from the sheet of metal of FIG. 6.
Figure 8:
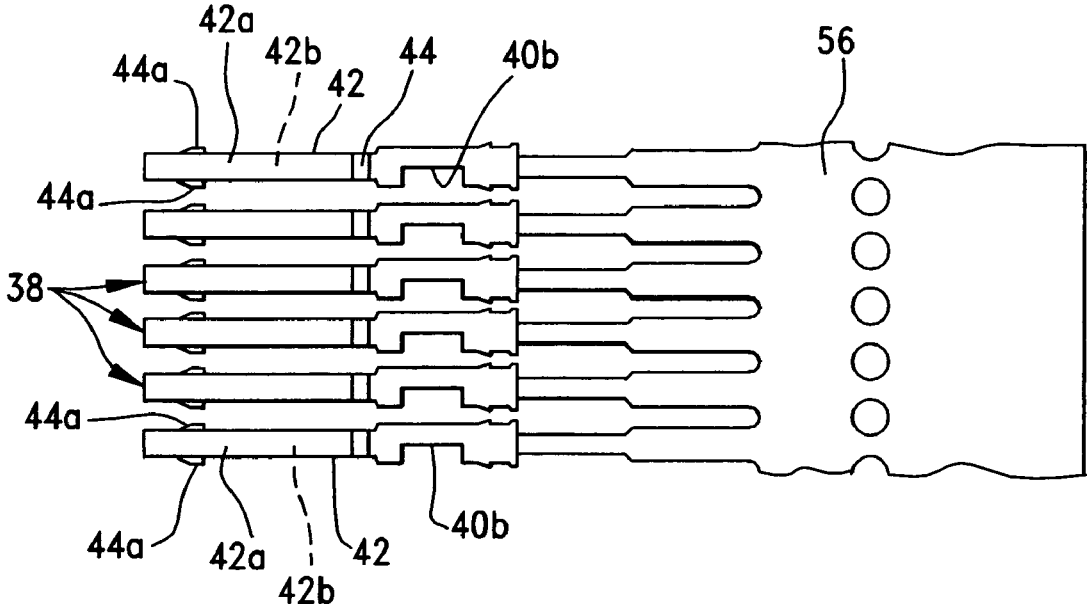
FIG. 8 is a plan view showing the stamped blank of FIG. 7, but with the front ends of the terminals folded upon themselves to define the opposing contact and termination surfaces of the terminals.

FIGS. 6–8 show the fabrication steps of terminals 38. The terminals are stamped from a sheet of conductive metal material, generally designated 54 in FIG. 6. The sheet is sized according to the number of terminals to be provided. A top surface 54*a* and a bottom surface 54*b* correspond to the top and bottom surfaces 42*a* and 42*b* of contact portion 42 of the terminals. Surfaces 54*a* and 54*b* may can be provided with the gold-plated layer 50 (FIG. 4) and the tin-plated layer 52 in selected positions where the top and bottom surfaces of contact end 42 are located on the sheet. This can be done by electrolytic plating, reflow plating, or any suitable plating process. Alternatively, the terminals may be plated after forming using a suitable plating process.

Sheet 54 may then be stamped to form a blank as shown in FIG. 7. The blank includes an array of terminals 38 joined to the carrier strip 56 which is located at the rear of the sheet metal plate. It can be seen that various components such as wings 40*a* and recesses 40*b* in mounting end 40, as well as wings 40*a* at the distal end of contact end 42 have been formed by stamping.

The stamped blank then undergoes forming steps to form the forward offset bend 44 between contact end 42 and mounting end 40 of the terminal that defines the first nest 80, as well as bending the tip of the forward end 44 at bend 46 back over onto the flat bottom surface 42*b* of the contact end of the terminal to define the second nest. This all is illustrated in FIG. 8. As shown best in FIGS. 3 and 5, the nests are arranged on the same side of the terminal and are offset or stepped, with respect to each other. In this manner, the second (forward) nest 82 can accommodate the exposed conductor(s) of the wire while the first (rearward) nest 80 can accommodate the outer insulation of the wires.

Figure 9:
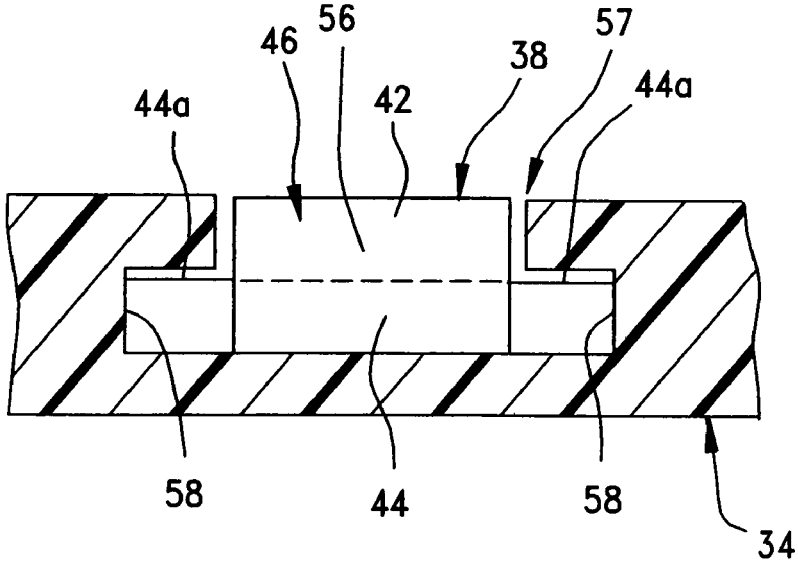
FIG. 9 is an enlarged isolated sectional view of the front end of the connector housing illustrates the wings at the distal end of the contact end of one of the terminals are held in and retained by grooves in the connector housing.

The terminals are then preferably inserted as a unit into the connector housing 34, with the carrier strip 56 still joined to the terminals. FIG. 9 shows how wings 44*a*, which project laterally outwardly of bent back forward end 46 of the terminal 40, are positioned within the connector. The connector housing 34 includes a series of T-shaped channels 57 that extend longitudinally through the connector housing and most preferably through the connector housing mating blade portion 34*c*. These channels 57 include a vertical slot 56 and horizontal grooves 58 that extend at an angle to the vertical slot 56 so that part of the housing, namely, the top surfaces of the grooves 58 serve as shoulders that retain the terminals by way of the terminal lateral wings 44*a*. This is best illustrated in FIG. 9. The outermost edges of the wings 44*a* may grip the grooves 58 in an interference-type fit in order to hold the forward ends 44 of the terminals in place within the housing. It can also be seen from FIG. 9 that the top contact surface 42*a* is preferably even with the top surface of the connector housing blade portion so that the blade portion is not enlarged in its height and the reduced height of the connector is maintained.

Figure 10:
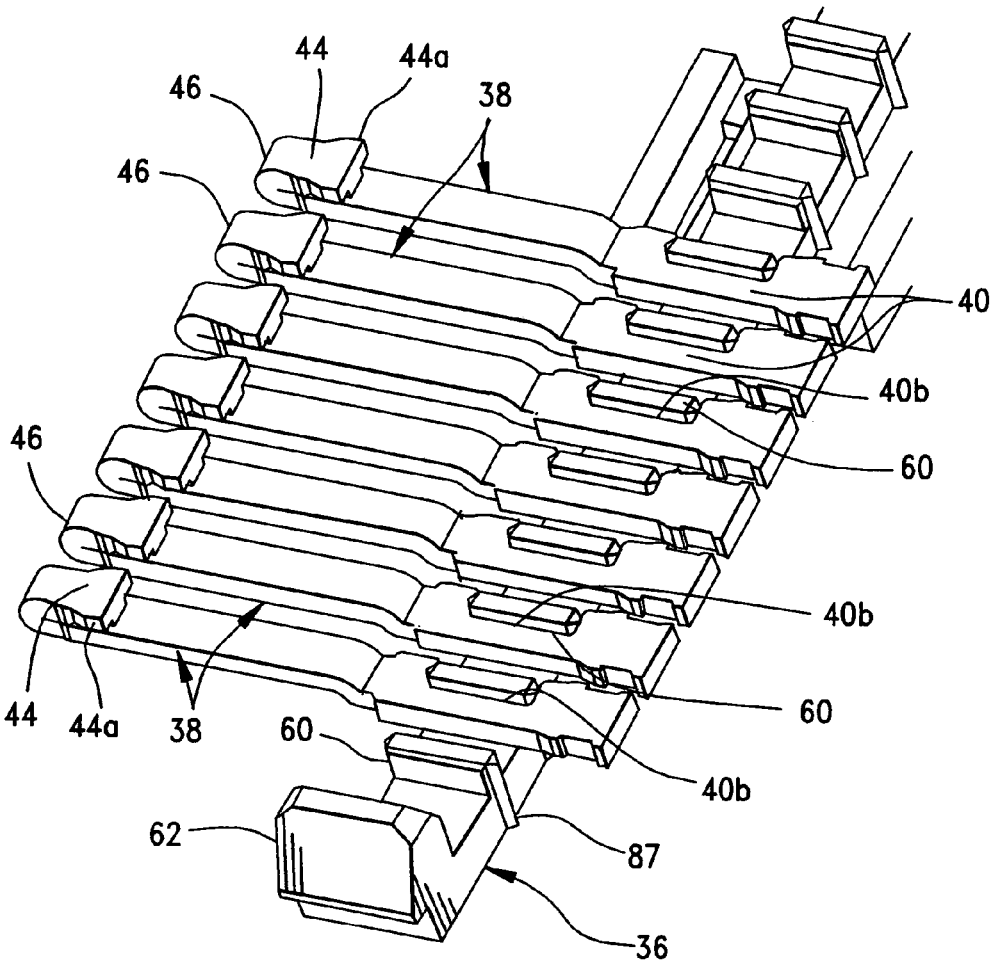
FIG. 10 is a perspective view of an array of terminals illustrating the terminals held in a side-by-side arrangement by the connector housing retainer member.

FIG. 10 shows how the retainer member 36 engages with the terminals 38 to hold the terminals in the housing and prevent any movement of the terminals in either the longitudinal direction (front to back) or the width (side-by-side) direction. Specifically, when the retainer member 36 is inserted into the opening 34*d* (FIG. 2) of the connector housing 34, the retainer member 36 has a plurality of retaining projections, or lugs 60 that are received within the recesses or notches 40*b* that are formed in the rear mounting ends 40 of the terminals. As seen in FIG. 3, each such notch 40*b* includes front and rear shoulders, 84 and 85, respectively which engage the retainer member lugs 60 by abutting their opposing front and rear surfaces. The notches also contain side shoulders 83 which engage a side of each lug 60. The retainer member engages the terminals along three sides 83, 84 and 85 thereof and therefore, the terminals are restricted in movement in either the longitudinal or widthwise directions thereof. The retainer member 36 has a pair of latch walls 62 disposed at opposite ends of a base portion thereof, which engage appropriate latching surfaces (not shown) in the interior of the connector housing top opening 34*d*. The retainer member 36 also preferably includes a plurality of interference members formed thereon, shown in FIGS. 2 and 10 as bumps 87 which engage, in an interference-type fit, sidewalls of the connector housing opening 34*d*.

Turning to FIG. 1, the retainer member 36 performs a dual function of not only retaining the terminals 38 in the housing 34, but it also retains the wires 32 in place the housing. Specifically, it can be seen in FIG. 1 that the retaining lugs 60 extend into the terminal notches 40*b* in the terminals and into abutting engagement with the wires 32 and specifically, the outer insulating covering 32*b*. It can be seen in FIG. 1, that the retaining lugs 60 are preferably pressed into the insulation of the wires to them in place in the connector housing. These retaining lugs 60 serve to resist pull out forces that may be applied to the terminals when the connector is mated or unmated with a mating connector. Also importantly, the lugs 60 serve to hold the wires in place, when the wires may be subjected to rotational or torsional forces, when a speaker portion of a cellular telephone is rotated relative to the telephone main body. In this regard, the lugs 60 extend past the bottom surfaces of the terminal mounting ends.

Figure 11:
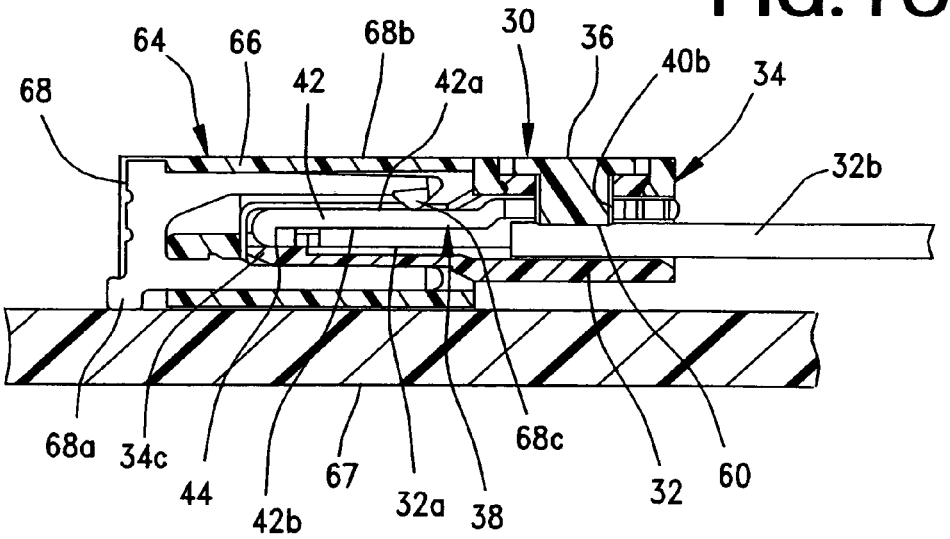
FIG. 11 is a section similar to that of FIG. 1, but showing the connector mated with a mating connector mounted on a circuit board.

FIG. 11 shows the electrical connector 30 of the present invention mated with a complementary mating connector 64, which includes an insulative housing 66 mounted on a printed circuit board 67. This Figure illustrates the nost common wire-to-board application for connectors of the present invention. The mating connector housing 66 mounts a plurality of U-shaped receptacle terminals 68 that have tail portions 68*a* for connection to appropriate circuit traces on the circuit board 67. The terminals 68 of the mating connector have flexible contact arms 68*b* provided with contact points 68*c* for engaging the gold-plated flat top surfaces 42 of contact ends 42 of terminals 38, when plug portion 34*c* of the cable connector is inserted into the U-shaped terminals 68.

Figure 12:
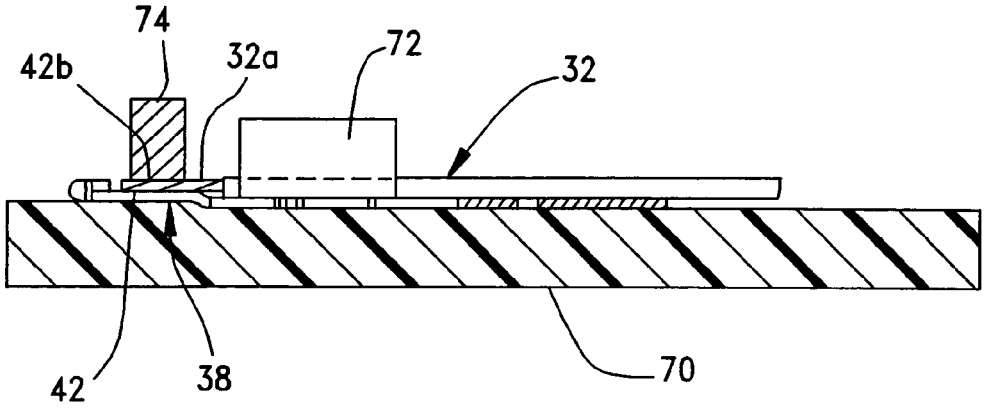
FIG. 12 is a schematic view of the step of soldering the exposed wires to an array of terminals to form a wire-terminal assembly.

FIGS. 12–17 show the fabrication and assembly steps of cable connector 30. First, FIG. 12 shows the stamped and formed blank illustrated in FIG. 8, positioned in a base jig 70 in an inverted orientation. Exposed conductors of wires 32 are positioned in alignment with the terminals, and solder may be applied to the terminal termination face and exposed wire conductors. A top jig 72 is then brought into place to hold the conductors on the terminals in proper alignment. A heater 74 then is brought into position to melt the solder and fix the wire conductors 32*a* to the tin-plated flat surfaces 42*b* of contact ends 42 of the terminals. Once the solder sets, a terminal assembly is formed.

Figure 13:
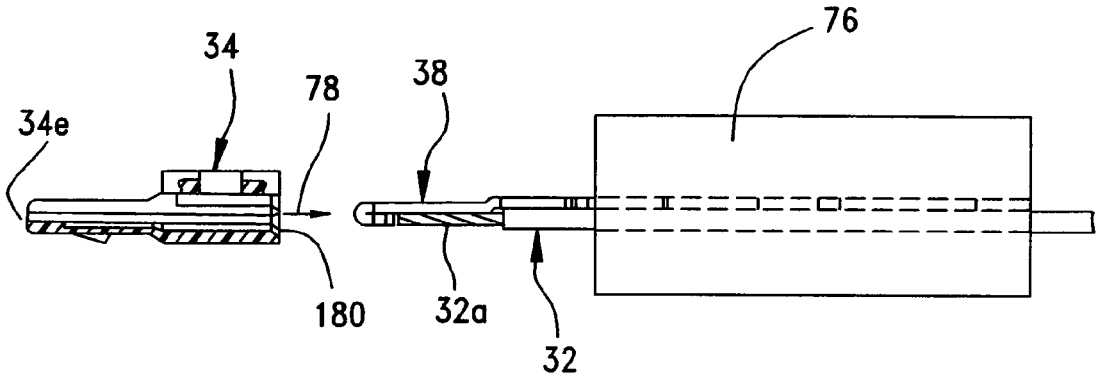
FIG. 13 is a schematic view of the step of insulating the wire-terminal assembly into a connector housing to form a housing assembly.
Figure 14:
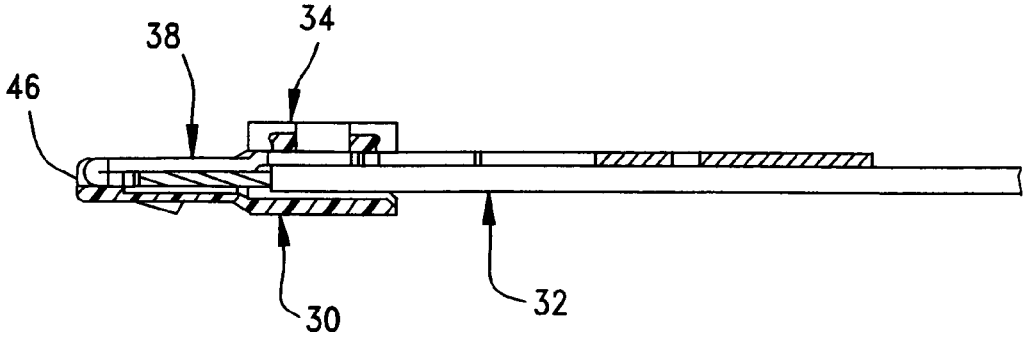
FIG. 14 is a sectional view of the housing assembly of FIG. 13.

The assembly of terminals 38 and terminated wires 30 is then positioned in a holder 76 as seen in FIG. 13, and the connector housing 34 is then moved in the direction of arrow 78 so that the contact ends of the terminals move through rear holes 80 in the housing to a position shown in FIG. 14, as wings 44*a* of bent forward ends 44 and wings 40*a* of rear mounting ends 40 of the terminal move into their respective grooves in the housing until the terminals and terminated cables are fully inserted as shown in FIG. 14. The resulting positions of the terminal 38 is illustrated best in FIG. 9, where the top contact surfaces 42 are exposed and are level with the top of the connector housing front mating end portion; and the retention wings 44*a* of the terminal forward ends 44 are retained in the housing terminal side grooves 58. The upper portions of the housing that extend over the grooves 58 serve to retain the terminal front ends 42 in place.

Figure 15:
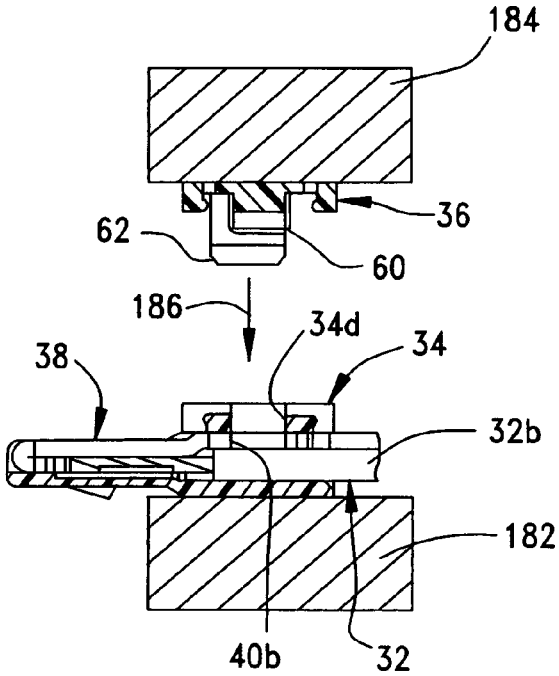
FIG. 15 is a schematic view of the step of aligning a terminal/wire retainer member with the connector housing.
Figure 16:
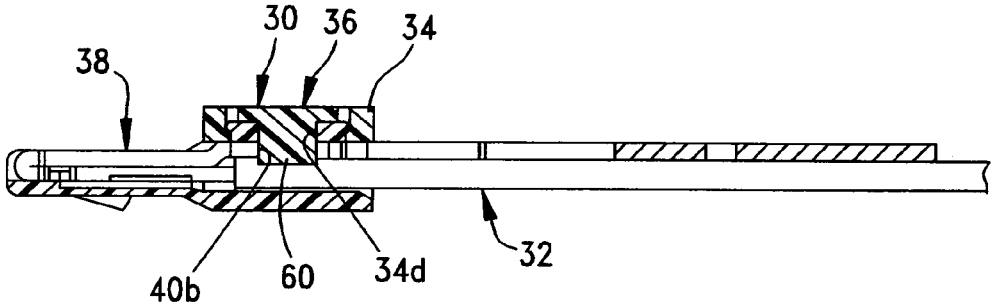
FIG. 16 is a schematic view of the housing assembly with the retainer member applied thereto.

The housing-terminal assembly of FIG. 14 then is positioned in an appropriate base jig shown schematically at 82 in FIG. 15. A retainer holder shown schematically at 84 then moves the retainer member 36 downwardly in the direction of arrow 86 into opening 34*c* in the top of the connector housing 34 moves downwardly into the recesses 40*b* formed in the rear mounting ends of the terminals 38. The retainer member now holds both the terminals and the cables within housing 34. It is important to note that the engagement recesses 40*b* of the terminals are formed in their rear tail portions and the recesses extend into the body of the rear tail portions 40. In this manner, an alignment is formed with the terminals which does not overly increase the width in the connector.

Figure 17:
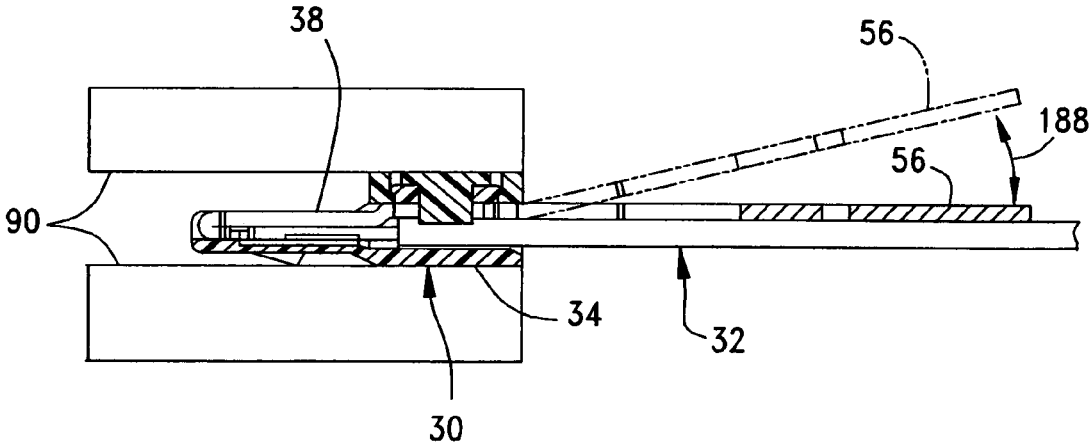
FIG. 17 is a schematic view of the step of removing the rear end of the terminal carrier strip from the terminal-housing assembly; and, FIGS. 18–20 illustrate a prior art connector.
Figure 18:
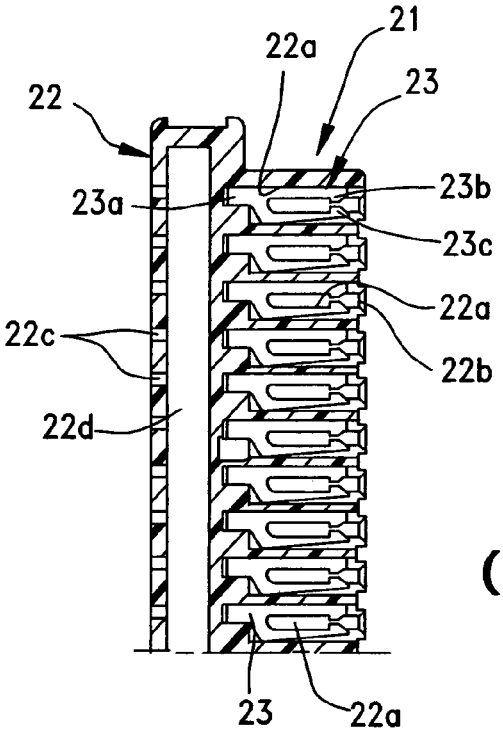
FIG. 18 (PRIOR ART)
Figure 19:
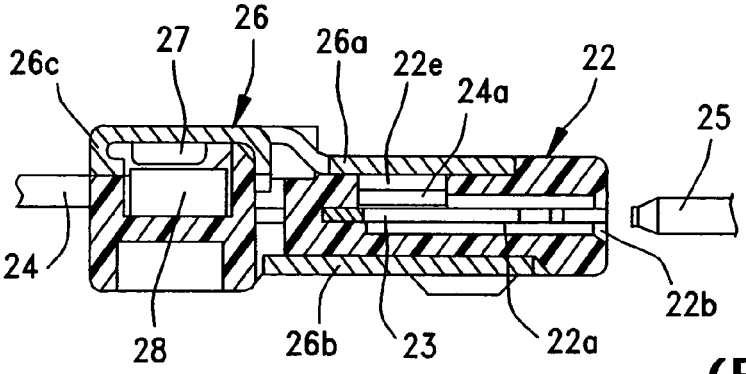
FIG. 19 (PRIOR ART)
Figure 20:
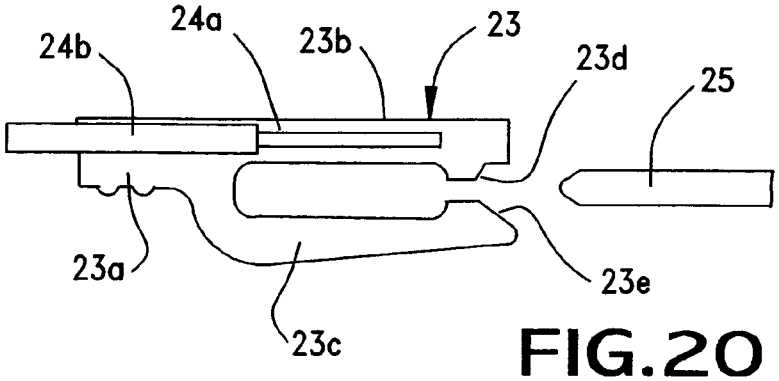
FIG. 20 (PRIOR ART)

Finally, the tail end of the carrier strip 56 then is removed as shown in FIG. 17, by bending the tail end back in the direction of arrow 88 to fracture the metal and remove the carrier strip from terminals 38, while the housing-terminal assembly 34 is held rigidly between a pair of appropriate jigs shown schematically at 90.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for connecting a plurality of wires with internal conductors arranged in a side-by-side pattern to a mating connector that is mounted to a circuit board, comprising:

an insulative connector housing, the connector housing including a body portion and a blade portion extending therefrom, the blade portion defining a mating end of said connector housing, said blade portion being insertable into the mating connector;

a plurality of conductive terminals supported by said housing in a side-by-side pattern, each of the terminals including a body portion having a contact end disposed at one end thereof and a mounting end disposed at an opposite end of the terminal body portion, said terminal body portion including distinct contact and termination surfaces disposed on opposite sides of said terminal body portion, the terminal contact surfaces being exposed on said blade portion and said terminal termination surfaces being disposed within said connector housing; and, each of said terminals including a first bend in their body portions, the terminal first bends defining first nests of said terminals, and portions of said wires being received within said first nests.

2. The connector of claim 1, wherein said terminal contact and termination surfaces include different plating layers disposed thereon.

3. The connector of claim 2, wherein said terminal contact surfaces are plated with gold or an alloy thereof and said terminal termination surfaces are plated with tin or an alloy thereof.

4. The connector of claim 3, wherein said terminals are formed from a solder-adherent resistant material.

5. The connector of claim 3, wherein said terminals are formed from one of the group consisting essentially of: phosphor-bronze, copper-nickel, copper, nickel or alloys thereof.

6. The connector of claim 1, further including a retainer member that engages said connector housing to retain said terminals and wires in place within said connector housing.

7. The connector of claim 6, wherein said connector housing includes an opening that extends along said connector housing transverse to said terminals, and the retainer member fits into said opening, the retainer member extending into contact with said terminals and said wires to retain said terminals and wires in place within said connector housing.

8. The connector of claim 6, wherein said retainer member includes a plurality of projections extending therefrom into said connector housing, each of the projections contacting a single one of said terminals and a single one of said wires.

9. The connector of claim 8, wherein each of said terminals includes a notch disposed thereon, and each notch receives one of said projections when said retainer is inserted into said connector housing.

10. The connector of claim 9, wherein said notches are disposed in said terminal mounting portions.

11. The connector of claim 1, wherein said terminal first bends offset said terminal mounting ends from said terminal contact ends.

12. The connector of claim 11, wherein each of said terminals includes a second nest to the second nest receiving an exposed conductor of one of said wires.

13. The connector of claim 12, wherein said second nest is disposed on said terminal proximate to said contact end and said first end is disposed on said terminal proximate to said mounting end.

14. The connector of claim 12, wherein exposed conductors of said wires are soldered to said termination surfaces of said terminals within said terminal second nest.

15. The connector of claim 11, wherein each of said terminals includes a second nest, the second nest receiving an exposed conductor of one of said wires.

16. The connector of claim 1, wherein a forward end of each of said terminals is bent back upon itself to define a second nest of each terminal that is disposed along said termination surface of said terminal.

17. The connector of claim 1, wherein said bent forward end defines a tip of said terminal contact end.

18. The connector of claim 1, wherein each of said terminals includes at least one wing projecting laterally outwardly from said contact end and said connector housing includes a plurality of terminal-receiving slots, each of the slots including a least one groove transverse to the slot that receives one of the terminals.

19. The connector of claim 18, wherein each of said terminals includes a pair of wings extending laterally therefrom and each of said connector housing terminal-receiving slots have a T-shaped configuration with a pair of grooves extending laterally from said slots, said terminal lateral wings being received within said grooves.

20. A connector, comprising:

an insulative housing having a body portion which includes a plurality of terminal receiving slots extend lengthwise along the housing body portions;

a plurality of conductive terminals, a single one of the terminals being received within a single terminal-receiving slot, each of said terminals having: a contact portion and a mounting portion disposed at opposite ends thereof, the mounting portion being offset from said contact portion and defining a first nest extending lengthwise underneath said mounting portion and said contact portion being bent upon itself to define a second nest extending lengthwise underneath said contact portion, said contact portion having a contact surface disposed on one side thereof and a termination surface disposed on an opposite side thereof.

21. The connector of claim 20, wherein said contact surface is plated with gold or an alloy thereof and said termination surface is plated with tin or an alloy thereof.

22. The connector of claim 20, wherein said terminal contact surfaces are flush with an exterior surface of said housing body portion.

23. An electrical connector for connecting a plurality of wires with internal conductors arranged in a side-by-side pattern to a mating connector that is mounted to a circuit board, comprising:

an insulative connector housing, the connector housing including a body portion and a blade portion extending therefrom, the blade portion defining a mating end of said connector housing, said blade portion being insertable into the mating connector;

a plurality of conductive terminals supported by said housing in a side-by-side pattern, each of the terminals including a body portion having a contact end disposed at one end thereof and a mounting end disposed at an opposite end of the terminal body portion, said terminal body portion including distinct contact and termination surfaces disposed on opposite sides of said terminal body portion, the terminal contact surfaces being exposed on said blade portion and said terminal termination surfaces being disposed within said connector housing; and, forward ends of said terminals being bent back upon themselves to define a nest of each terminal that is disposed along said termination surface of said terminal, the nests receiving exposed ends of said conductors.

24. An electrical connector for connecting a plurality of wires with internal conductors arranged in a side-by-side pattern to a mating connector that is mounted to a circuit board, comprising:

an insulative connector housing, the connector housing including a body portion and a blade portion extending therefrom, the blade portion defining a mating end of said connector housing, said blade portion being insertable into the mating connector;

a plurality of conductive terminals supported by said housing in a side-by-side pattern, each of the terminals including a body portion having a contact end disposed at one end thereof and a mounting end disposed at an opposite end of the terminal body portion, said terminal body portion including distinct contact and termination surfaces disposed on opposite sides of said terminal body portion, the terminal contact surfaces being exposed on said blade portion and said terminal termination surfaces being disposed within said connector housing; and, wherein each of said terminals include first and second nests formed therein, the first nests receiving portion of said wires therein, and the second nests receiving exposed conductors of said wires therein.

25. The connector of claim 24, wherein each of said terminals includes an offset bend and the offset bend defines said first nest.

26. The connector of claim 25, wherein said offset bends are disposed in said terminal body portions.

27. The connector of claim 25, wherein each of said terminals includes a forward ends thereof bent back upon itself, the bent forward ends define said second nest.

* * * * *